United States Patent [19]

Barnett

[11] 4,374,320

[45] Feb. 15, 1983

[54] MOTORIZED OVEN DOOR LATCH AND CONTROL CIRCUIT FOR SAME

[75] Inventor: Eugene J. Barnett, Mansfield, Ohio

[73] Assignee: White Consolidated Industries, Inc., Cleveland, Ohio

[21] Appl. No.: 264,470

[22] Filed: May 18, 1981

[51] Int. Cl.[3] ..... A21B 1/00; F27D 11/02

[52] U.S. Cl. ..... 219/413; 126/197; 219/398; 219/494; 292/DIG. 69

[58] Field of Search ..... 219/398, 412, 413, 494; 126/197, 200, 273 R; 292/7, 113, 201, 144, DIG. 69

[56] References Cited

U.S. PATENT DOCUMENTS

| | | | |
|---|---|---|---|
| Re. 27,545 | 1/1973 | Guy | 219/412 |
| 3,099,471 | 7/1963 | Scott et al. | 292/7 |
| 3,121,158 | 2/1964 | Hurko | 219/413 X |
| 3,474,226 | 10/1969 | Kauranen | 219/413 |
| 3,521,618 | 7/1970 | Smith et al. | 126/197 |
| 3,565,054 | 2/1971 | Smith | 126/197 |
| 3,735,750 | 5/1973 | Detterbeck et al. | 126/197 |
| 3,745,988 | 7/1973 | Frick | 126/273 R |
| 3,808,402 | 4/1974 | Rea | 219/413 |
| 3,859,979 | 1/1975 | Gilliom | 126/197 |
| 3,894,214 | 7/1975 | Staples | 219/394 |
| 3,968,983 | 7/1976 | Heit et al. | 292/201 |
| 4,013,312 | 3/1977 | DeWeese | 292/113 |
| 4,082,077 | 4/1978 | Marfatia et al. | 126/197 |
| 4,230,350 | 10/1980 | Gee et al. | 292/144 |
| 4,316,079 | 2/1982 | Schmitz | 219/413 |
| 4,340,806 | 7/1982 | Bergquist | 219/413 |

*Primary Examiner*—Volodymyr Y. Mayewsky
*Attorney, Agent, or Firm*—Pearne, Gordon, Sessions, McCoy & Granger

[57] ABSTRACT

An L-shaped hooked end of a latch rod, rotatably supported by a range body, engages a door-supported cam surface as the rod is rotated on its longitudinal axis by a motor to effect oven door locking. The cam surface is fixed at and radially spaced from the center of an elongated member whose ends are fastened to the oven door. As the latch hook engages and rides the cam surface, the elongated member is placed in torsion to provide a biasing force that maintains the locked oven door in tight sealing engagement with the range body. The motor rotating the latch rod to effect oven door locking and unlocking is actuated solely by operator manipulation of the oven thermostat control apart from the oven selector and timer controls.

14 Claims, 10 Drawing Figures

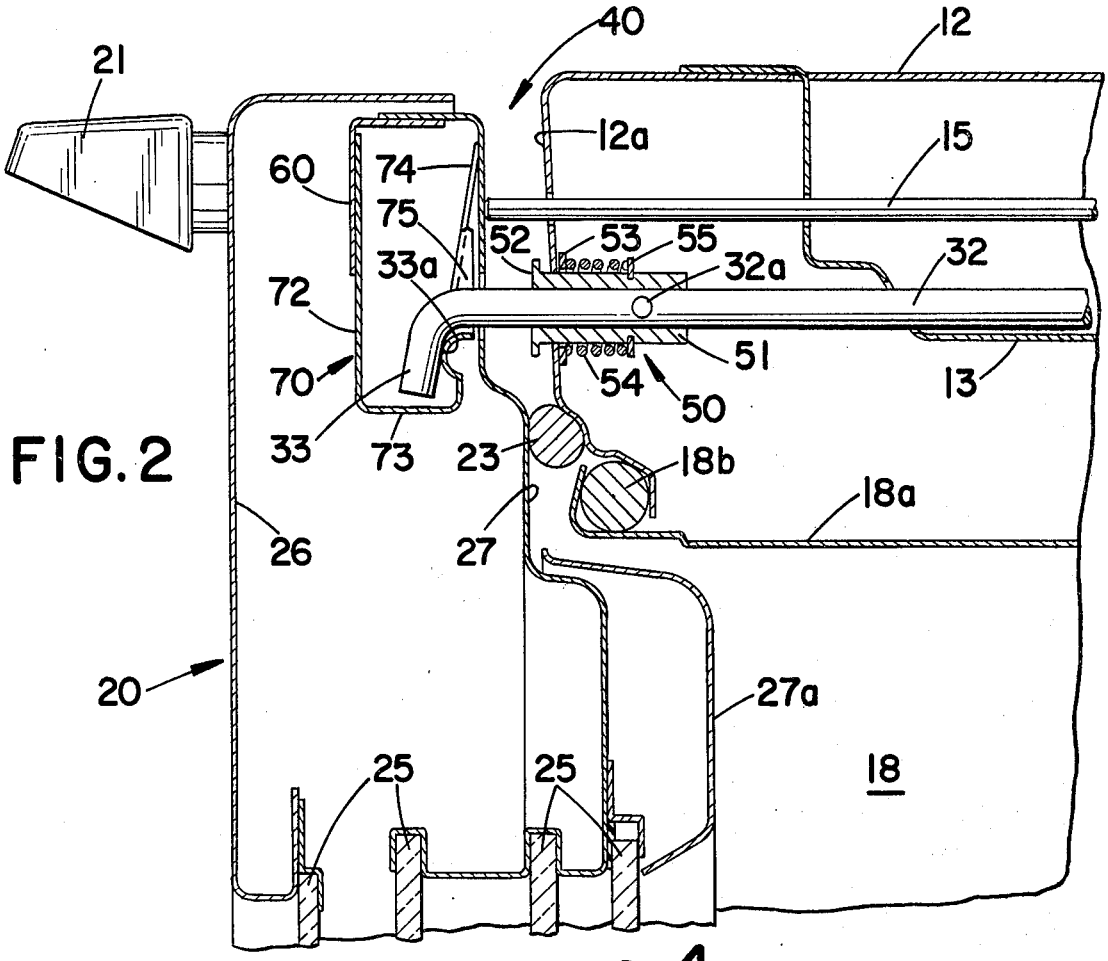
FIG. 2
FIG. 3
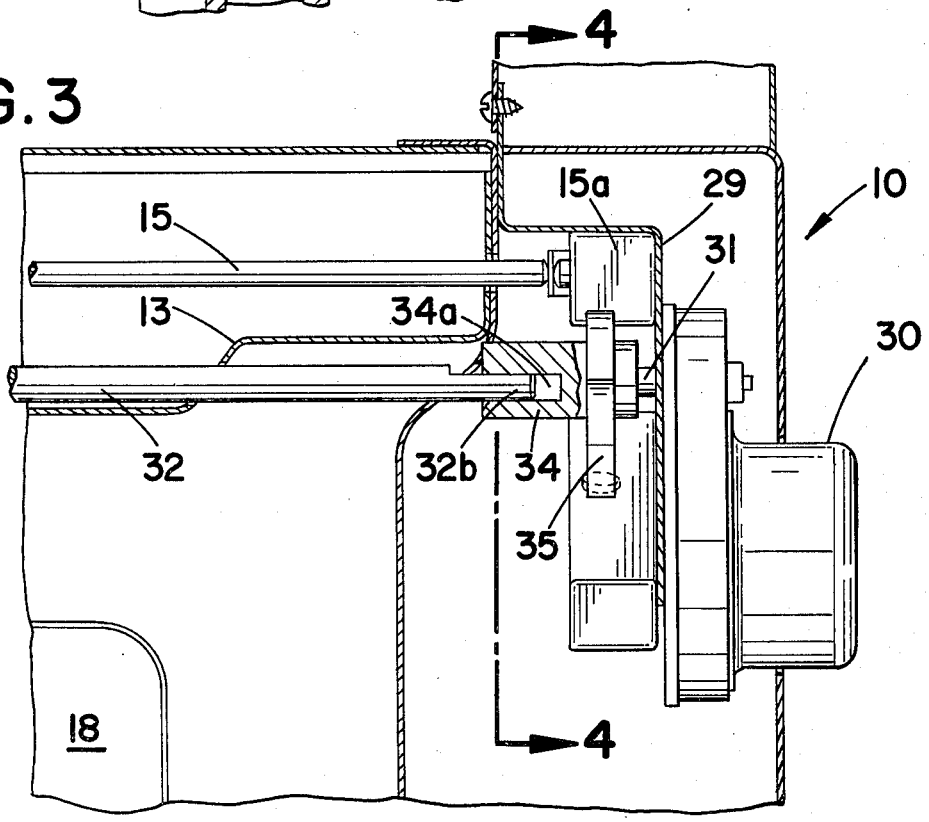

FIG. 7
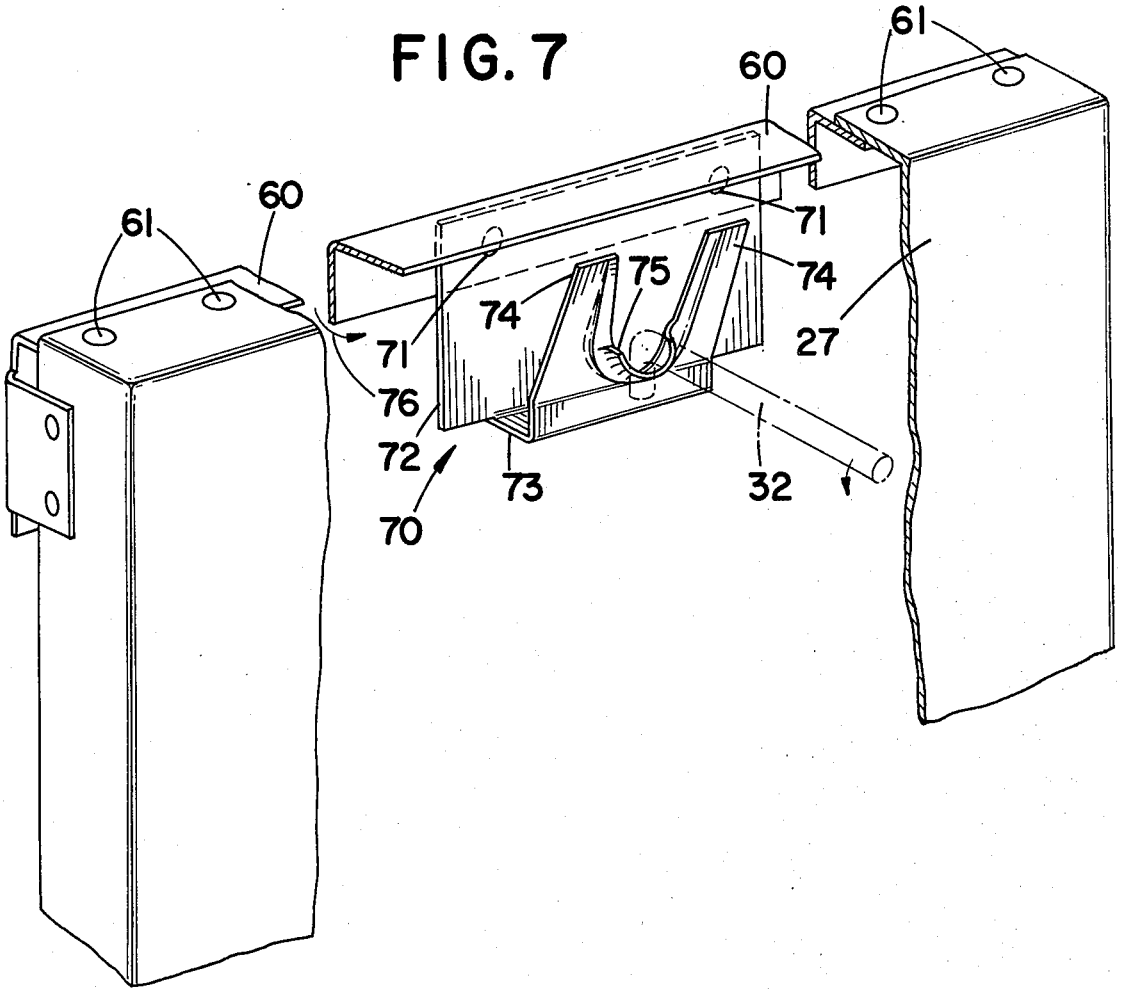
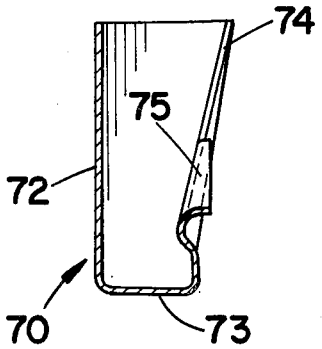
FIG. 9
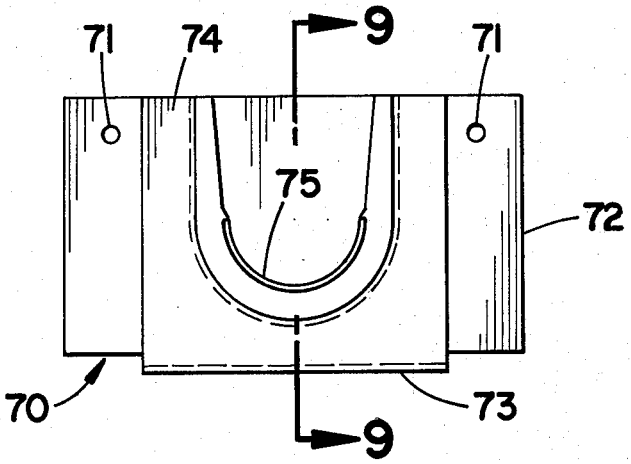
FIG. 8

MOTORIZED OVEN DOOR LATCH AND CONTROL CIRCUIT FOR SAME

BACKGROUND OF THE INVENTION

The present invention relates to a latch for locking a door in a closed position, and in particular to a motorized oven door securing latch used to preclude access to a self-cleaning domestic range oven undergoing a high temperature pyrolytic cleaning cycle.

Motorized self-cleaning oven door latches are well known in the art as represented by U.S. Pat. No. 3,859,979 to Gilliom and U.S. Pat. No. Re. 27,545 to Guy. Latches of the type illustrated by these patents include a rotary motor mounted at a rearward portion of the range body above the oven chamber and a reciprocating latch hook at a forward portion of the range body, the latch hook being engageable with a keeper fixed to the closed oven door.

To effect reciprocating movement of the latch into and out of engagement with the keeper, a translationally movable, longitudinal member is provided between the motor means and the latch hook.

In U.S. Pat. No. 3,859,979, the longitudinal member is a latching rod motor driven back and forth along its axis by an eccentric mount in reciprocating fashion to and away from the oven door while being cocked from side to side as it moves with a cam rivet to effect door latching and unlatching. In U.S. Pat. No. Re. 27,545, an eccentric drive arrangement moves a latch rod back and forth along its axis in reciprocating fashion to effect latching and unlatching of a latch member with an associated oven door.

In both of the above-noted prior art devices, it is necessary to convert the rotational movement of an accompanying rotary drive motor into translational motion to effect reciprocating movement of the latch rods. The resultant mechanisms are necessarily complex and, as a result of their complexity, are high in cost. Since the domestic appliance business is extremely cost competitive, and since long-term durability is a major factor in appliance design, there is great need for a less costly and simpler motorized latch mechanism to replace mechanisms of the type illustrated by the above-noted patents.

Further, the user control of such motorized latches should be simple, straightforward, and of a fail-safe nature to provide for a hazard-free oven cleaning operation. Multiple control manipulations performed by the user in a complex sequence to effect door latching should be avoided without risking safety.

It is the purpose of the present invention to meet all the criteria noted above with regard to a more ideal motorized oven door latch and control of the same.

SUMMARY OF THE INVENTION

A motorized oven door latch mechanism is provided for securely locking the door of a pyrolytic self-cleaning oven in a closed position. The latch mechanism includes a motor means supported by the range body, the motor means having a rotatable drive shaft. An elongated latch rod having a hook portion at one end extending generally radially away from the longitudinal axis of the rod is rotatably driven by the drive shaft, the latch rod being restrained against free translational movement along its axis at at least one point. An elongated member has its end portions fixed to the oven door. A cam surface, fixed to the center portion of the elongated member and radially spaced from the member's longitudinal axis, engages with the hook portion of the rod as it is rotated. As the rod rotates, a pulling force on the cam surface places the elongated member in torsion to bias and maintain the door in tight sealing engagement with the range body.

In a preferred form, the drive shaft is connected to the non-hook end of the rod by a coupling that permits limited axial movement of the latch rod relative to the drive shaft under conditions of thermal expansion and contraction affecting the door latch mechanism. Further, a spring member for restraining the latch rod against free movement along its axis is compressed by the pulling force on the cam surface, wherein both the spring member under compression and the elongated member under torsion cooperate to bias and maintain the oven door in tight sealing engagement with the range body.

To control the door latch, a circuit is provided having a single control knob oven thermostat rotatable between full clockwise and full counterclockwise end position, a high temperature pyrolytic oven cleaning position of the thermostat being located at one of the end positions of the thermostat knob. The thermostat includes a separate pair of contacts for applying power directly to the motorized latch when the oven door is closed, the contacts being closed to apply power to the motor means of the latch mechanism only when the knob of the thermostat is at the clean position.

A fuller understanding of the invention may be had by referring to the following description and claims, taken in conjunction with the accompanying drawing.

BRIEF DESCRIPTION OF THE DRAWINGS

FIG. 2 is a sectional view of the front portion of the oven door latch illustrated in FIG. 1;

FIG. 3 is a sectional view of the rearward portion of the oven door latch illustrated in FIG. 1;

FIG. 7 is a perspective view of a portion of the oven door having a cam surface providing member engaged with a latch hook portion of the latch mechanism;

FIGS. 8 and 9 are elevational and cross-sectional views, respectively, of the cam surface providing member as illustrated in FIG. 7.

DETAILED DESCRIPTION OF THE PREFERRED EMBODIMENT

Figure 1:
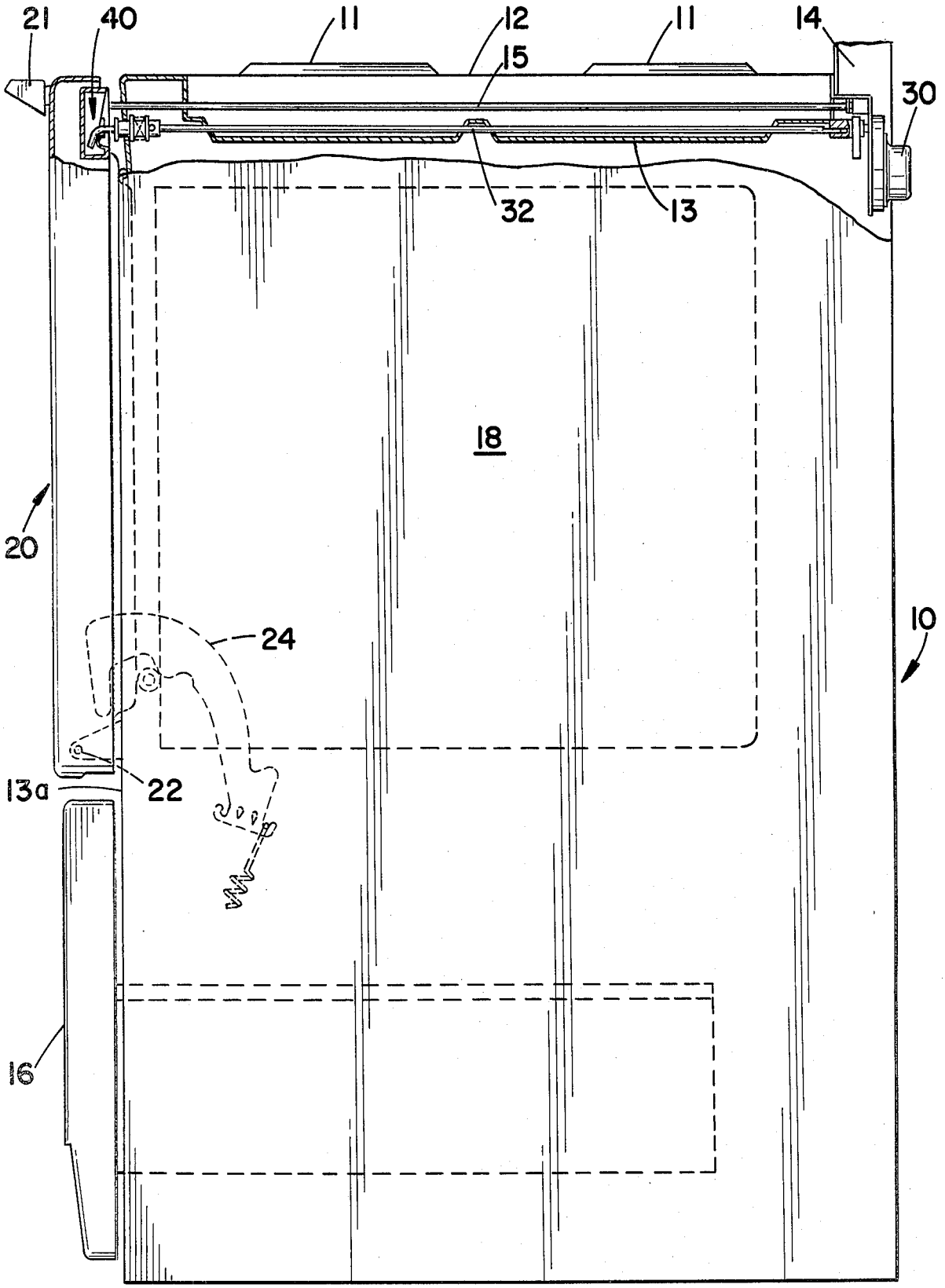
FIG. 1 is a side elevational view of a domestic range with portions cut away, the range including a pyrolytic-type self-cleaning oven and a motorized oven door latch in accordance with the present invention.

With reference to FIG. 1, there is illustrated a conventional domestic range of the free-standing type, including a pyrolytic self-cleaning oven, the range being equipped with a motorized oven door latch in accordance with the present invention. The range includes a four-sided range cabinet or body 10, preferably formed of enameled sheet metal and internal frame members assembled around an oven cavity 18. The body 10 supports a cooking platform or burner surface member 12, which in turn supports a plurality of surface heating units or burners 11 of the electric resistance or gas heating type. Typically, four burners 11 (only two shown) are supported by the surface 12, the burners being spaced from each other to form a rectangular pattern, wherein a pair of back burners are provided along with a pair of forward burners. Extending upwardly from the back edge of the burner surface 12 is a control panel 14 which houses user-actuated controls such as an oven thermostat control, an oven function selector switch, and a timer for cycling the oven on and off over a desired time period.

The forward wall 13*a* of the range body 10 includes a pair of rectangular apertures, the lower aperture receiving a conventional cooking utensil storage drawer 16, while an upper aperture permits user access to the self-cleaning oven cavity 18. The access opening of the cavity 18 is closed by an outwardly opening, hinge-mounted oven door 20 swingable from a vertical closed position to an open horizontal position on a conventional hinge means 22. A handle 21 located at the top edge of the door allows the user to position the door at a partially open broil position or at a fully opened position against the biasing effect of a spring-loaded detent type oven door hinge member 24.

In a known manner, the oven cavity 18 can be highly heated to a temperature in excess of 750° F., wherein the walls of the oven chamber or cavity 18 are self-cleaned by pyrolytic action. Such a phenomenon is more fully detailed in U.S. Pat. No. 3,121,158 to Hurko, the entirety of which is herein incorporated by reference. During a pyrolytic cleaning cycle, it is imperative that the oven user not be able to open the oven door 20, since the rapid influx of oxygen-rich air into the cavity 18 could result in an explosion of combustible gases generated therein, or hot, noncombustible gases escaping from the oven could injure the user.

To provide such oven door locking, a latch mechanism in accordance with the present invention is provided to lock the oven door 20 in its closed position as illustrated in FIG. 1.

The latch mechanism includes a rotary motor means 30 including appropriate reduction gearing, the motor 30 rotating an elongated latch hook rod 32 extending through a plurality of apertures in a sheet metal formed superstructure 13 constituting a portion of the range body 10. The rod 32 is generally of circular cross section and extends from the back portion of the range, where the motor 30 is mounted, to the forward portion of the range wherein the distal hook end of the rod can engage and disengage with the oven door 20 at a hook/keeper interface area 40. Also extending from the front of the range to its rearward portion is a door position monitoring rod 15 which opens and closes a switch when the rod's distal end abuts and is moved into the range body by the upper end portion of the closed oven door 20.

Turning to FIG. 2, there is illustrated in greater detail the hook/keeper interface area 40 discussed earlier with regard to FIG. 1. The door 20 includes an outer door panel 26 and an inner door panel 27, the panels being spaced from each other to receive a plurality of conventional glass panels 25 which thermally insulate the outer portions of the oven door window area from the highly heated oven chamber 18 undergoing pyrolytic cleaning. An inner door window frame 27*a* assists in retaining the innermost glass panel 25 in its proper position.

Positioned between the panels 26 and 27 at the upper intermediate portion of the door 20 is a keeper 70 which is secured to the upper distal end of the bottom-hinged oven door 20 in a manner to be subsequently discussed in greater detail.

The keeper 70 is generally of a U-shaped cross section having an outside leg 72, a horizontally extending bottom shelf portion 73, and an upwardly extending inside leg 74. At the lower center portion of the inward leg 74, there is provided an aperture or cutout area having a moon-shaped lower lip constituting a cam surface 75 upon which an L-shaped, radially extending hooked end 33 of the rod 32 will ride during a locking and unlocking cycle of the door locking mechanism. Movement of the rod 32 back and forth along its axis is only restrained at one point, such restraining being provided by axial compression of a biasing means 50. In assembling the latching rod 32 in its position within the range body 10, an aperture is provided in the forward edge 12*a* of the burner surface member 12, such aperture being preferably centered at a position located intermediate the left and right edges of the oven door 20. An appropriately sized aperture through the forward edge 12*a* is also provided to permit the forward distal end of the door position monitoring rod 15 to project forward of the wall 12*a* for engagement in abutting fashion with the top edge of the panel 27 as the oven door 20 is closed and opened. A tubular bushing 51 is fixed in position on the hook end portion of the rod 32 by an appropriate retaining pin 32*a* extending diametrically through an appropriate hole drilled through the rod: The forward end of the tubular bushing 51 includes a flange 52 of a diameter greater than the aperture through which the rod 32 projects through the front wall 12*a* such that the flange 52 precludes the bushing 51, and thus the rod 32, from being pulled into the upper portion of the range body 10, the flange 52 in effect forming a stop. On the inner side of the wall 12*a*, there is provided a conventional washer 53 slidable onto the tubular bushing 51. A biasing spring 54 of the helical type is sandwiched between the washer 53 and a split ring retaining clip 55 retained in position on the bushing 51 is an appropriate circumferentially extending groove. The spring 54 can thereby be compressed to bias and force the latch rod 32 toward the back portion of the range, which supports the motor means 30 (FIG. 1).

In FIG. 2, the oven door 20 is illustrated at its closed position, with the hook end 33 of the latch rod 32 fully engaging the cam surface 75 at its highest cam height to tightly retain the oven door 20 in a locked condition wherein a conventional oven door seal 23 is slightly compressed to seal the oven door 20 relative to the range body. Such an arrangement precludes uncontrolled inlet of air into the oven chamber 18 undergoing the pyrolytic cleaning cycle. Further, the walls, such as the top wall 18*a*, defining the oven chamber are sealed against oven wall supporting portions of the range body 10 by an appropriate seal 18*b* extending peripherally about the forward, rectangular edge of the oven chamber defing walls. To provide adequate compression of the oven door seal 23, the cam surface 75 as illustrated is ramped to or from a high cam point to gradually increase and then decrease its distance away from the forward edge 12*a* of the range body 10. As the rod 32 is rotated on its longitudinal axis from a starting position wherein the generally radially extending hook portion 33 extends upwardly, the inner face 33*a* of the hook portion 33 will ride the cam surface 75 toward its high point to more fully compress the spring 54, the spring 54 exerting a counterpulling force on the keeper 70, which is fixed to the horizontally extending longitudinal member 60 supported only at its ends, as shown in FIG. 7.

With the oven door in its locked position as illustrated in FIG. 2, the spring 54 is compressed, as illustrated, with the rod 32 being pulled outwardly away from the range body towards engagement with the high point of the cam surface 75 provided by the keeper 70, which will place the member 60 in torsion. In pulling the rod outwardly from within the range body, the flange 52 will end up in a spaced position slightly away from the forward edge 12*a* as shown, the distance of such space indicating the amount of additional compression placed on the spring 54. It is also noted that the upper end of the legs 74 of the keeper 70 rides against and abuts the inner section of the door panel 27 to limit the amount of torsion placed on the member 60. With the oven door at its locked position as illustrated in FIG. 2, preferably the spring 54 is fully compressed to provide a rigid structure precluding further movement of the rod outwardly from within the range body. Also, the upper edge of the legs 74 tightly engages and locks in place relative to the inner surface of the panel 27 to limit torsion of the member 60. In such a condition, the user in gripping the handle 21 cannot open the oven door. Thus, in accordance with the present invention, by simple rotation of the rod 32, an effective, rigid locking of the door at its fully closed position is provided, with adequate compression of the seal 23 precluding hazardous air inlet to the pyrolytically heated oven chamber 18.

Turning to FIG. 3, there is illustrated in greater detail a means for rotationally driving the latch rod 32. The motor means 30, which includes appropriate reduction gearing of a conventional nature, is fixed to a motor support member or plate 29, which in turn is solidly fastened to a rigid structural support portion of the range body 10. The motor means 30 is preferably mounted as illustrated to the back portion of the plate 29, which has an aperture through which a motor drive shaft 31 extends. The drive shaft 31 is fixed to a coupling 34 having an axially extending, noncircular or semicircular aperture or bore which slidingly receives a correspondingly noncircular or semicircular cross-sectional end 32*b* of the rod 32, the shaft 31, rod 32, and coupling 34 being coaxially rotational relative to each other. The end 32*b* is received within the coupling 34 and rotatably locked relative thereto, while permitting limited axial movement or sliding of the shaft end 32*b* into and out of coupling 34, wherein a variable lost motion space 34*a* is provided. With reference to FIGS. 2 and 3, it can be seen that the rod 32*a* is axially held in biased position by the biasing means 50 which permits the rod to move outwardly toward the door during locking engagement of the hook portion 33 with the cam surface 75. Such a structure, wherein the end 32*b* of the rod 32 can slide into and out of the coupling 34, also permits the latch mechanism to compensate and adjust for thermal expansion and contraction of the range body 10 and related structures, particularly during a high self-cleaning cycle. It is noted that the space 34*a* as illustrated in FIG. 3 must at least be equal to the space between the flange 52 (FIG. 2) and the front of the oven wall 12*a* wherein disengagement of the hooked end 33 of the latch rod 32 from the high point of the cam surface 75 permits the spring 54 to snap the latch rod back into the axially fixed coupling 34, wherein the flange 52 of the bushing 51 engages and abuts the front wall portion 12*a* about the latch rod aperture receiving the bushing 51.

With further reference to FIG. 3, a rotatable cam member 35 is fixed to the coupling 34, the cam member actuating a pair of microswitches, to be discussed subsequently. It is also noted that the door position monitoring rod 15 has its rearward end fixed to a spring member of a door-mounted microswitch 15*a*, which functions in a known manner within the control circuitry of the oven to, for example, turn on and off a light within the oven chamber 18.

With reference to FIGS. 7, 8, and 9, there is illustrated in greater detail the positioning and construction of the door keeper 70.

The longitudinal member 60 is preferably constituted by a horizontally extending piece of steel angle iron. The ends of the member 60 are fixed to the upper edge of the inner door panel 27 by, for example, pairs of fasteners such as rivets or spot welds 61. The center portion of the member 60 is thus free to twist in a limited fashion on its longitudinal axis if loaded by a torsion-providing force. Such a twisting force is provided by mounting of the keeper 70 to the vertically extending leg of the member 60, such mounting being accomplished by a pair of fasteners such as rivets or spot welds 71. It can be seen that the moon-shaped cam surface 75 provided by the upwardly extending leg 74 (comprised of two parallel portions as illustrated) is radially spaced from the longitudinal axis of the member 60 wherein a lever action pulling force on the cam surface 75 provided by the rotating spring-biased latch rod 32 will cause a torsioning or twisting force to be applied to the member 60, as indicated by force arrow 76. The amount of torsion is controlled by the abutment of the upper edge of the leg portion 74 of the keeper 70 with the inner portion of the inner wall 27 of the oven door 20, as discussed earlier with regard to FIG. 2.

With particular reference to FIGS. 8 and 9, the keeper 70 is preferably formed by bending a precut, flat sheet of steel into the desired shape, wherein the moon-shaped cam surface 75 is provided at the lower portion of a U-shaped cutout section of the upper leg 74. Thus, the torsion force on the member 60 will tend to generate a pulling force on the latch rod 32, which in turn is subjected to an opposed pulling force by the spring 54 (see FIG. 2), such forces causing the oven door to be tightly engaged with the range body to seal it during a pyrolytic cleaning operation.

Figure 4:
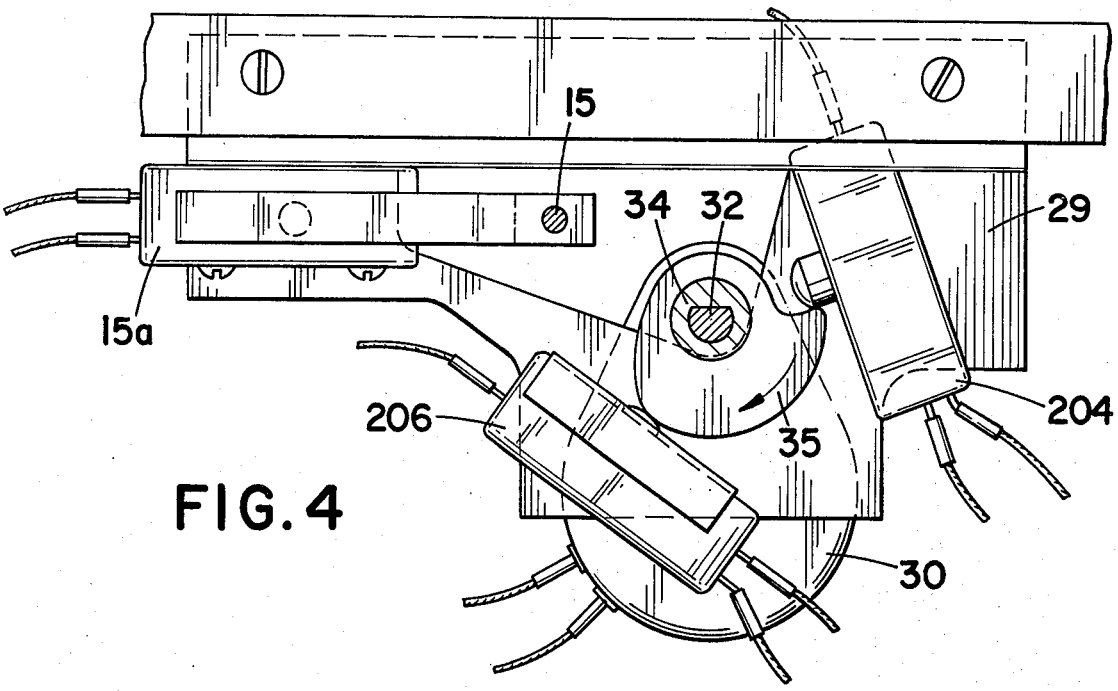
FIGS. 4, 5, and 6 illustrate the movement of a cam member carried by the drive shaft of a motor actuating the latch mechanism, the cam member sequentially actuating switch means to effect desired closing and opening sequences of the latch.
Figure 5:
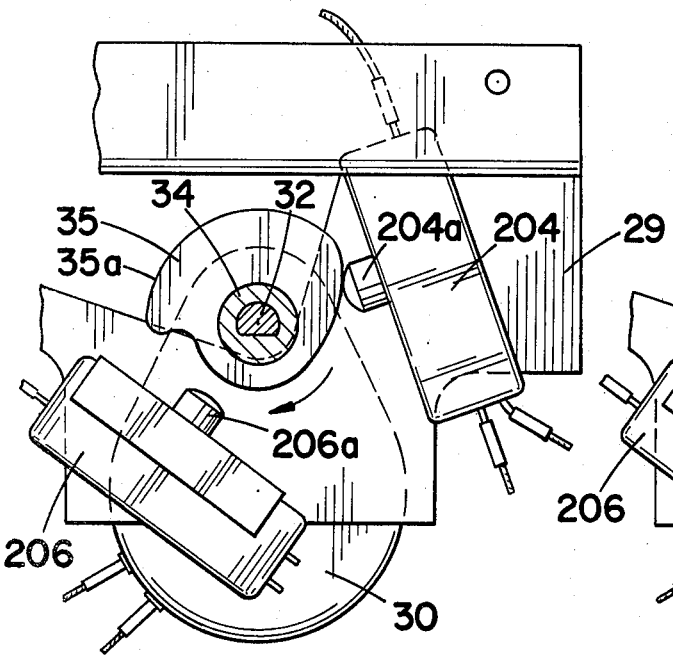
Figure 6:
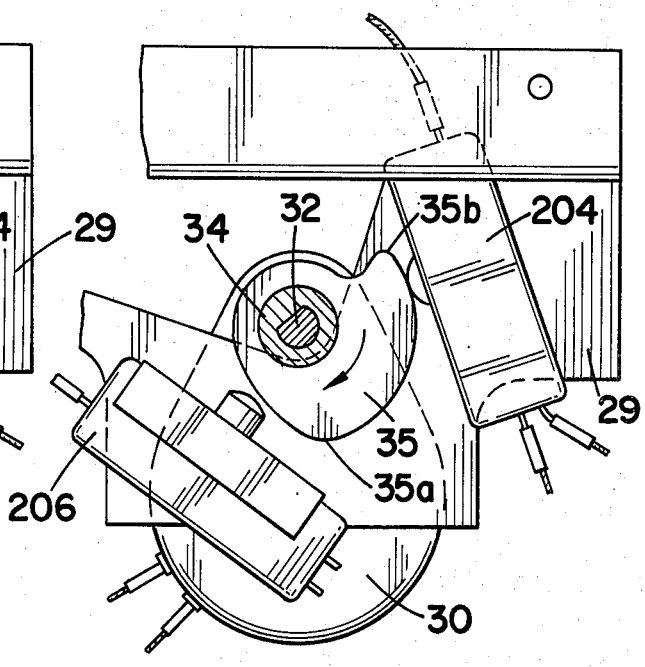

With reference to FIGS. 4, 5, and 6, there is illustrated in greater detail a cam member 35 at various rotational positions relative to a latch motor microswitch 204 and an interlock microswitch 206, both of such switches being of the single-pole, double-throw type. The general function of the switches 204, 206 in relation to the rotating cam member 35 is well known in the art, as described by earlier-noted U.S. Pat. No. Re. 27,545, assigned to the assignee of the present invention, such patent being herein incorporated in its entirety by reference. In general, as viewed from the front of the range, the switch 204 opens and closes to permit energization of the motor 30 for a period of time which will only result in 180 degrees of rotation of the latch rod 32. Thus, the cam member outer peripheral surface 35*a* engages with a switch button 204*a* for the switch 204 to move it in and out of a motor-actuating position for only approximately 180 degrees of its rotation. In a similar manner, the switch 206 actuated by a switch button 206*a* engageable with the outer peripheral cam surface of the cam member 35 is opened and closed on each 180 degrees of latch rod rotation in a manner to preclude inadvertent pyrolytic heating of the oven under a door-open condition.

A clear understanding of the function of switches 204 and 206 as they relate to locking and unlocking rotation of the latch rod 32 as discussed earlier may be had by referring to FIG. 10, which discloses, in accordance with the present invention, a simple means for locking the oven door. Reference to the earlier-incorporated U.S. Pat. No. Re. 27,545 is also made as illustrating a typical self-cleaning oven sequence but for the departure of the invention from such prior art teachings as noted below. It is noted that while FIG. 10 is directed to a resistance type heating element oven, it is clearly contemplated that the present invention is also intended for gas-heated, self-cleaning ovens or other equivalents wherein locking of a door during a period of oven operation is desired.

Figure 10:
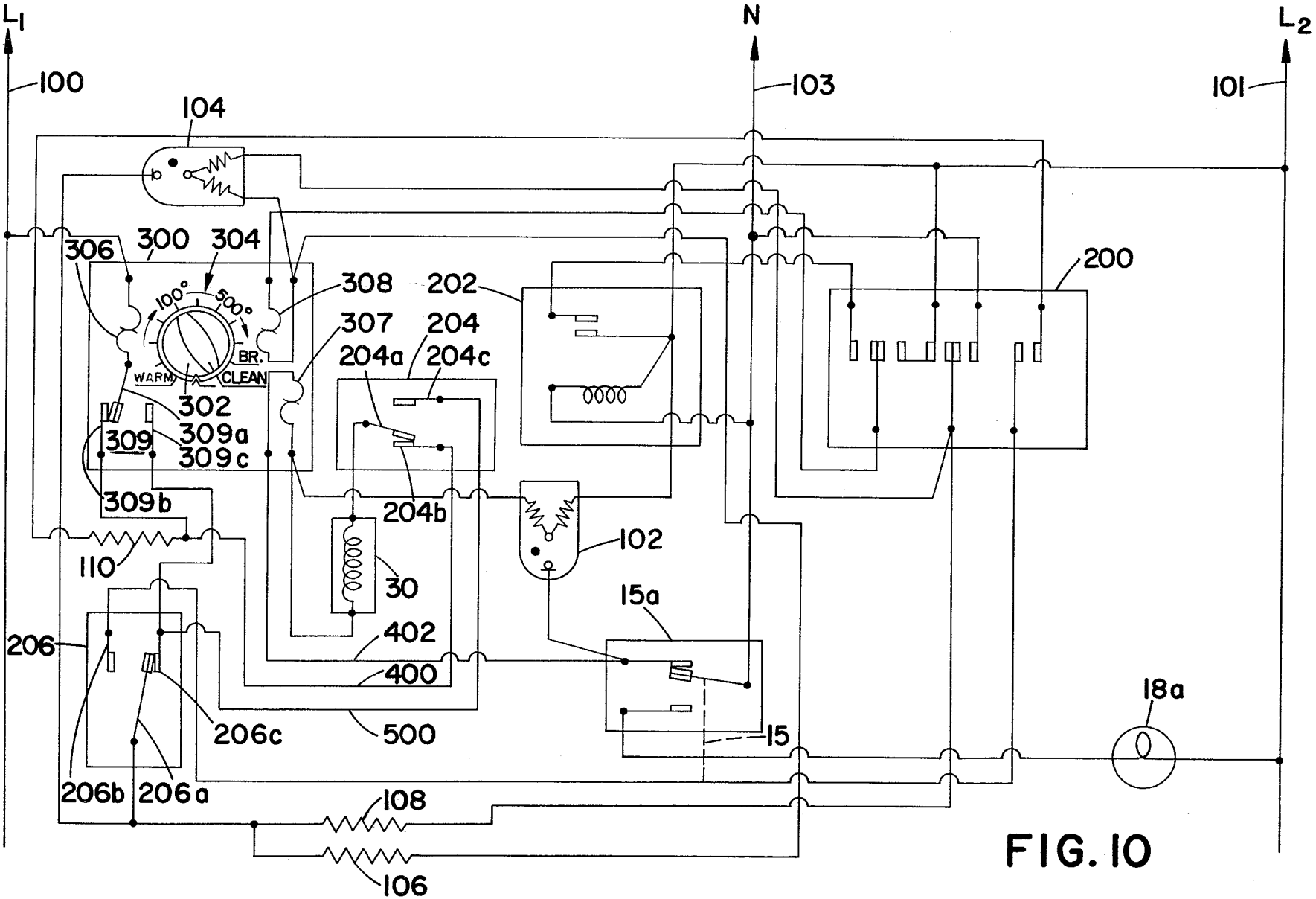
FIG. 10 is a control circuit in accordance with the present invention for regulating the latching and unlatching of the oven door.

Turning specifically to FIG. 10, in a conventional manner, a pair of power lines 100, 101 and a neutral line 103 are provided to the oven (conventional commercial power, e.g., 220 VAC, 60 Hz) control circuit. In a simple form, the oven heating elements typically include a single bake oven heating element 106 and a broil oven heating element 108. The circuit of FIG. 10 is also shown to include a conventional smoke eliminator catalytic element 110, which functions in a known manner to minimize smoke that escapes from the oven cavity 18 (FIG. 1) during a self-cleaning operation via a conventional vent outlet (not shown). A conventional selector switch 200 having plural sets of contacts functions in a known manner to permit various operating cycles of the oven, including a self-cleaning cycle. The control circuit of FIG. 10 also has a conventional oven timer 202, a conventional door lock indicating light 102, and a conventional oven pilot light 104.

In accordance with the present invention, an oven thermostat 300 is provided, the thermostat 300 having a single operating knob 302 rotatable from a counterclockwise "warm" position to a full clockwise "clean" position (as illustrated), the knob being engageable at various positions, and in particular at the clean position, with a detent means of conventional design. It can be seen that in rotating the knob 302 clockwise from its "warm" position to its "clean" position, a gradually increasing range of oven temperature in the bake mode is provided with the broil element 108 alone being at its full "on" condition for maximum heating when the knob 302 is at the indicated broil position (BR). In addition to adjustable thermostat elements 306,308 of a known type for regulating oven temperature, the thermostat 300 includes a door unlock disable thermostatic switch element 307. In accordance with the invention, a set of single-pole, double-throw contact switch means 309 are provided for actuation by associated known mechanical elements actuated in turn by rotation of the knob 302 to and away from its full clockwise end position (clean). It is noted that the temperature at which the thermostatic elements 306, 308 concurrently open and close is determined by the position of the knob 302, while thermostatic element 307 is not adjustable by rotation of such knob but, rather, will switch to a non-conducting condition as a predetermined temperature which it senses is exceeded.

With the knob 302 at its "warm" position (full counterclockwise rotation), a movable contact 309*a* of the switch means 309 is spaced from a fixed cleaning contact 309*b* and is in contact with a normal baking cycle contact 309*c*. When the knob 302 is rotated fully clockwise to its "clean" position (full clockwise rotation), element 306 being in a closed conducting condition, a suitable mechanical member moves the movable contact 309*a* into engagement with the contact 309*b* (out of engagement with control 309*c*) to actuate the earlier-discussed motorized latch of the oven door regardless of the setting of the selector switch 200 or the timer 202. Such a procedure greatly simplifies locking and unlocking of the door.

A locking and unlocking sequence will now be discussed, it being understood that the starting point for such a sequence is in a door-unlock condition with the switches 204 and 206 in position as illustrated in FIG. 10.

Upon rotation of the oven thermostat knob 302 to the "clean" position, contacts 309*a* and 309*b* are closed, with thermostat means 306 and 308 being mechanically adjusted to a high-temperature, self-cleaning condition. Power from line 100 is provided via thermostat means 306 and contact pair 309*a*, 309*b* to a first lock energization line 400 which provides power to the lock motor 30 via a fixed contact 204*b* to a movable contact 204*a* of the latch motor switch 204. Such applied power to the motor 30 is returned to the neutral line 103 via a return line 402 which is tied to the door monitor switch 15, illustrated in its door closed position. Thus, the motor 30 is energized and turns the latch rod 32 (see FIG. 3) for approximately 180 degrees of rotation wherein the latch hook rod tightly engages the cam surface 75 as discussed earlier with regard to FIGS. 1–3, the movable contact member 204*a* then being switched by the cam surface 35*a* (FIG. 6) to its other fixed contact 204*c*. This sequence is known in the art, and is more fully discussed in the earlier-incorporated U.S. Pat. No. Re. 27,545.

At this point, the motor 30 will be de-energized, since an alternate motor energizing line 500 connected to the terminal 309*c* of door lock switch 309 is isolated from the power line 100. It is also noted that the interlocking switch 206 has moved from the position illustrated in FIG. 1 to a second cleaning position wherein the movable contact 206*a* engages a clean mode fixed contact 206*b* and disengages from a normal bake mode fixed contact 206*c* to precondition the oven circuit for a self-cleaning operation. The interlock switch 206 further precludes high heating of the elements to effect oven cleaning where the oven door is not locked as indicated by failure of the cam member 35 (FIGS. 4, 5, and 6) to switch movable contact 206*a* from fixed contact 206*c* to fixed contact 206*b*. Again, it is noted that such function of switch 206 is known in the art as illustrated by the earlier-noted U.S. reissue patent.

To effect unlatching of the oven door at the end of a self-cleaning cycle, thermostat means 307 must be closed, indicating that the oven temperature has dropped below a hazardous level wherein oven door opening is allowable. In manually moving the knob 302 from its clean position counterclockwise through its various bake positions, the movable contact 309*a* is swung into contact with fixed contact 309*c* (where it normally remains except at the "clean" position) wherein line 500 is energized to power the motor 30 for another 180 degrees of unlocking rotation.

It can be seen that a control circuit is provided wherein the contacts 309*a* and 309*c* are in electrical series relationship with the oven thermostat 306, which is operable at a nonconducting or fully conducting state, the thermostat means regulating the oven temperature in both a normal oven heating mode (bake and broil) and a high temperature cleaning mode, power to the motorized latch mechanism to effect oven door locking being provided solely by the thermostat means wherein the thermostat means is always in a fully conducting condition at or below a predetermined pyrolytic cleaning temperature (e.g., 750° F.) within the oven when the control knob is at a clean position.

Unlike prior art motorized oven door latch control circuits, the selector switch 200 and the timer 202 have no part to play in effecting oven door latching and unlatching, thus presenting the oven user with a simple and straightforward means of locking and unlocking the oven door. The selector 200 and the timer 202 simply function as means for initiating and setting the duration of a self-cleaning cycle, as is known in the art. Further, the door control circuitry illustrated in FIG. 10 is of a simpler design than previous motorized latch control circuits. Finally, the door lock circuit of FIG. 10, while being simpler, still provides for nonhazardous operation of the oven wherein conventional fail-safe means (e.g., interlock switch 206 and door monitor switch 15*a*) are provided to preclude energization of the oven into a self-cleaning mode without proper locking of the oven door. While only the door lock circuit portions of FIG. 10 have been specifically discussed as relevant to the present invention, the operation and function of other illustrated components of FIG. 10 will be apparent to one skilled in the art.

Although the preferred embodiments of this invention have been shown and described, it should be understood that various modifications and rearrangements of parts may be resorted to without departing from the scope of the invention as disclosed and claimed herein.

What is claimed is:

1. In a domestic range having a body including an outwardly opening, pyrolytic self-cleaning oven chamber, electrical heating means supplying heating energy into the oven chamber and a hinge-mounted oven door supported by the body and movable from an open to a closed position to preclude access to the oven chamber, a motorized oven door latch mechanism for locking the oven door in a closed position, comprising:

a motor means supported by the range body, the motor means having a rotatable drive shaft;

an elongated latch rod having at one end a hook portion extending generally radially away from the longitudinal axis of the rod, the other end of the rod being rotatably driven by the drive shaft, the latch rod being restrained against free translational movement along its axis relative to the range body at at least one point;

an elongated member having its end portions fixed to the oven door;

a cam surface fixed to the center portion of the elongated member, the cam surface being radially spaced from the longitudinal axis of the elongated member, wherein with the oven door closed, the latch rod hook portion can be rotated by the motor means to engage the hook portion with the cam surface to exert a pulling force on the cam surface and place said elongated member in torsion to bias and maintain the over door in tight sealing engagement with the range body.

2. A domestic range according to claim 1, including a coupling member for rotationaly connecting the rod to the drive shaft, the coupling member permitting limited axial movement of the latch rod relative to the drive shaft under conditions of thermal expansion and contraction affecting the door latch mechanism.

3. A domestic range according to claim 1, including a spring means, said restraining of the latch rod against free movement along its axis being provided by said spring means, said spring means being compressed by said pulling force on the cam surface, said force tending to move said elongated rod away from said motor means, said spring means cooperating with said elongated member to bias and maintain the oven door in tight sealing engagement with the range body.

4. A domestic range according to claim 3, including stop means to limit the degree of torsion applied by the rotating latch rod to the elongated member during periods of high thermal expansion, said spring member being generally fully compressed when the stop means limits said degree of torsion, said pulling force required to compress said spring member being approximately equal to the pulling force required to place said elongated member in torsion.

5. In a domestic range having a body including an outwardly opening, pyrolytic self-cleaning oven chamber, electrical heating means supplying heating energy into the oven chamber and a hinge-mounted oven door supported by the body and movable from an open to a closed position to preclude access to the oven chamber, a motorized oven door latch mechanism for locking the door in a closed position comprising:

a motor located at the rear portion of the range body above the oven chamber, the motor being supported by the range body and including a drive shaft, the distal end of the drive shaft providing a coupling sleeve;

an elongated latch rod extending from the rearwardly located motor through an aperture in a front wall of the range body above the oven chamber, the latch rod being restrained against free movement along its axis relative to the range body at at least one point, the rearward end of the latch rod being received into the sleeve to rotationally fix the drive shaft to the elongated rod, the forward end of the latch rod terminating in a hook portion extending generally radially away from the axis of the rod, the hook portion being forward of the front of the range body and projecting within the interior portion of the oven door when in a closed position;

an elongated member fastened at its end portions to and within the interior of the oven door, the elongated member being perpendicular to the latch rod; and a cam member having one end fixed to the central portion of the elongated member, another end of the cam member providing a cam surface spaced from the longitudinal axis of the elongated member, the cam surface being configured as a ramp of increasing distance away from the front of the range body when the oven door is at a closed position, the hook portion upon rotation of the motor engaging and riding up the ramp-configured cam surface to pull the oven door into sealing engagement with the front of the range body, the elongated member being placed in torsion to maintain the oven door in said sealing engagement.

6. A domestic range according to claim 5, wherein the drive shaft and the elongated rod are on a common axis of rotation, the rearward end of the rod being free to slide into and out of the sleeve in response to thermal expansion and contraction affecting the door latch mechanism, the sleeve interior diameter cross section being noncircular and mating with a correspondingly noncircular cross-sectional end of the rod to preclude rotation of the rod within the sleeve.

7. A domestic range according to claim 5, wherein said rod rotates only in one direction, said cam surface being discontinuous wherein continued rotation of the latch rod causes said hook portion to ride off and disengage from said cam surface to permit unlocking and opening of the oven door.

8. A domestic range according to claim 7, wherein, with said oven door closed, the hook portion of the latch rod engages with the cam surface for about 180 degrees of each full rotation of the latch rod.

9. A domestic range according to claim 5, wherein said elongated member is positioned horizontally above the latch rod, the cam member hanging downwardly from the elongated member, the lower end portion of the cam member providing the cam surface.

10. In a domestic range having a body including an outwardly opening, pyrolytic self-cleaning oven chamber, electrical heating means supplying heating energy into the oven chamber, a hinge-mounted oven door supported by the body and movable from an open to a closed position to preclude access to the oven chamber, and a motorized oven door latch mechanism for locking the oven door in a closed position, a control circuit for actuating the motorized latch mechanism, comprising:

an oven thermostat having a single control knob rotatable between full clockwise and full counterclockwise end positions, the control knob having a plurality of oven temperature positions and a high temperature pyrolytic oven cleaning position located at one of said end positions, the thermostat including a pair of contacts as the sole means for applying power directly to said motorized latch to effect door locking when the oven door is closed, said contacts being closed to apply said power to the motorized latch only when said control knob is at said cleaning position.

11. A domestic range according to claim 10, wherein said contacts are in electrical series relationship with said oven thermostat means operable at nonconducting or fully conducting states, the thermostat means regulating the oven temperature in both a normal oven heating mode and a high temperature cleaning mode, power to the motorized latch to effect oven door locking being provided via the thermostat means, wherein said thermostat means is always in a fully conducting condition at or below a predetermined pyrolytic cleaning temperature within the oven when said control knob is at said cleaning position.

12. A domestic range according to claim 10, wherein said contacts can be opened only by manual rotation of the control knob out of the cleaning position, the motorized latch remaining in a locked position under all range operating conditions when said control knob is at said cleaning position.

13. A domestic range according to claim 10, wherein said cleaning position is at said clockwise end position, the indicated oven temperature at said oven temperature positions of said control knob increasing with clockwise rotation of the control knob.

14. A domestic range according to claim 13, including detent means for maintaining the knob at the cleaning position until moved from said cleaning position by manual rotation of the control knob.

* * * * *